US005494461A

United States Patent [19]

Bippus et al.

[11] Patent Number: 5,494,461

[45] Date of Patent: Feb. 27, 1996

[54] TERMINAL BLOCK FOR HIGH TRANSMISSION RATES IN THE TELECOMMUNICATION AND DATA TECHNIQUE

[75] Inventors: Hans-Dieter Bippus, Hogate; Robert A. Fitzgerald, Bateau Bay; Bryce L. Nicholss, Avoca Beach, all of Australia

[73] Assignee: Krone Aktiengesellschaft, Berlin-Zehlendorf, Germany

[21] Appl. No.: 279,436

[22] Filed: Jul. 25, 1994

[30] Foreign Application Priority Data

Jul. 27, 1993 [DE] Germany ..... 43 25 952.9

[51] Int. Cl.[6] ..... H01R 9/22

[52] U.S. Cl. ..... 439/709; 439/922; 439/719

[58] Field of Search ..... 439/402, 403, 439/709–712, 715–719, 723, 724, 922; 361/119

[56] References Cited

U.S. PATENT DOCUMENTS

| | | | |
|---|---|---|---|
| 4,846,735 | 7/1989 | Teichler et al. | 439/709 |
| 4,851,967 | 7/1989 | Gerke et al. | 439/709 X |
| 4,871,330 | 10/1989 | Muller et al. | 439/709 |
| 5,114,356 | 5/1992 | Taybl et al. | 439/713 |
| 5,160,273 | 11/1992 | Carney | 439/108 |

*Primary Examiner*—Khiem Nguyen
*Attorney, Agent, or Firm*—McGlew and Tuttle

[57] ABSTRACT

A terminal block for high transmission rates in the telecommunication and data technique. The terminal block includes a plastic casing and metal insulation displacement contact elements inserted pair-wise in at least two parallel rows into the casing with connected contact fingers forming spring contacts. The flat insulation displacement contact elements are formed at the narrow side webs including the contact slot therebetween and of the base web. The width of the spring contacts is small.

15 Claims, 4 Drawing Sheets

TERMINAL BLOCK FOR HIGH TRANSMISSION RATES IN THE TELECOMMUNICATION AND DATA TECHNIQUE

FIELD OF THE INVENTION

The present invention relates to a terminal block for high transmission rates in the telecommunication and data field or technique, and in particular to a terminal block comprising a plastic casing and metal insulation displacement contact elements inserted pair-wise in at least two parallel rows into the casing with connected contact fingers forming spring contacts.

BACKGROUND OF THE INVENTION

There is known in the art a terminal block of the type referred to hereinbefore from U.S. Pat. No. 5,160,273. Therein, the problem of crosstalk between adjacent insulation displacement contact elements is intended to be solved by insertion of a plurality of electrically conductive shielding plates between the individual pairs of insulation displacement contact elements. The problem of crosstalk occurs when transmitting high volumes of information over electrical lines and the information is being transmitted at high frequencies. The transmission of such high frequencies will generate a radiation and an interference between adjacent lines, in particular when such lines are closely adjacent to each other in the terminal block. By insertion of the electrically conductive shielding plates, a higher crosstalk attenuation is intended to be achieved. Application of large-surface, electrically conductive shielding plates in the terminal blocks requires, however, an increased constructional size of the terminal blocks and a higher cost when manufacturing the terminal blocks.

SUMMARY AND OBJECTS OF THE INVENTION

It is therefore the object of the invention to provide a terminal block for the type referred to hereinbefore, for high transmission rates in the telecommunication and data technique, wherein the problem of crosstalk is eliminated or substantially reduced with low expenditure of technical and economical efforts.

The solution of this object is achieved, according to the present invention, by that the flat insulation displacement contact elements are formed of very narrow side webs including the contact slot therebetween and of a narrow base web connecting the latter only, and that the width of the spring contacts is as small as possible. By this substantial reduction in size of the insulation displacement contact elements by reducing the surface areas of the insulation displacement contact element as well as of the contact fingers connecting the latter, the capacities between two parallel conductive plates are considerably reduced, thereby a strong crosstalk attenuation or an improvement of the crosstalk values being achieved. This applies for a pair of adjacent insulation displacement contact elements connected with a pair of cable wires as well as for adjacent insulation displacement contact elements connected to different pairs of cable wires.

In another embodiment of the present invention, a considerably improved crosstalk attenuation can be obtained by that the spacing of two adjacent pairs of insulation displacement contact elements of a row is larger than the spacing of the two insulation displacement contact elements of a pair. Thereby, the capacities of adjacent pairs of insulation displacement contact elements aligned in a row are further reduced, and the crosstalk values are further improved.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
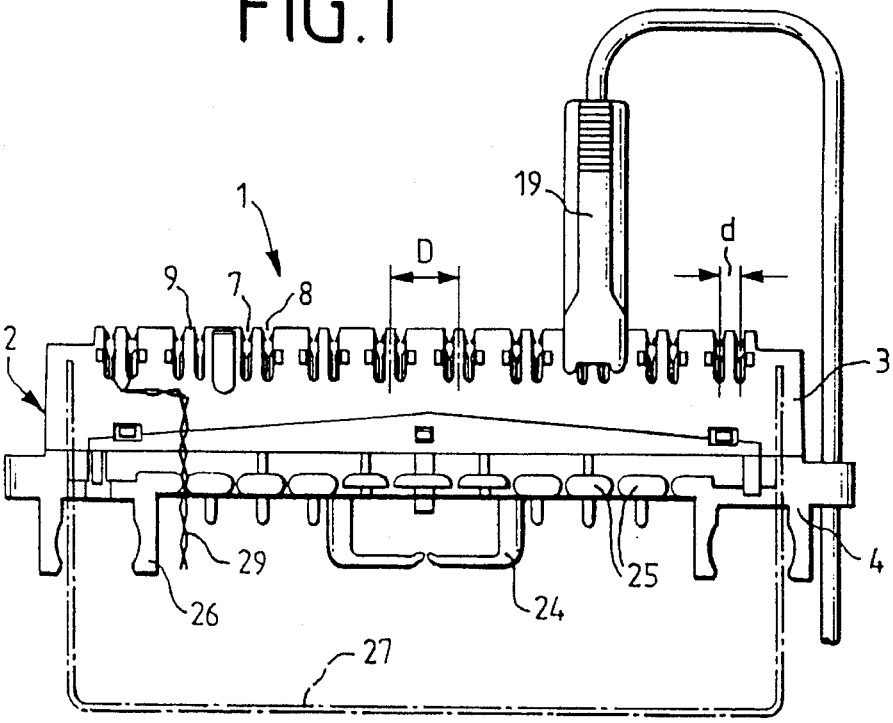
FIG. 1 is a view of the first embodiment of the terminal block.

The terminal block according to the first embodiment shown in FIGS. 1 to 5 serves for high transmission rates in the telecommunication and data field and technique. The terminal block 1 comprises a plastic casing 2 composed of an upper portion 3 and a lower portion 4 being latched with each other by latch openings 5 in the upper portion 3 and latch lugs 6 in the lower portion 4. In the upper portion 3 are provided clamping slots 7 with integral clamping lugs 8 and clamping webs 9 serving to receive insulation displacement contact elements 10.

Figure 2:
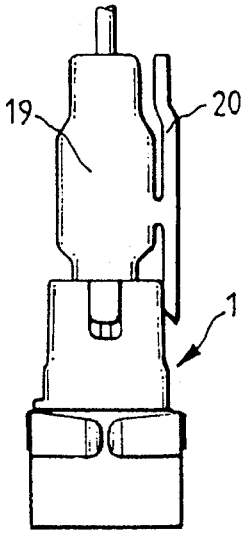
FIG. 2 is a side view according to FIG. 1.
Figure 5:
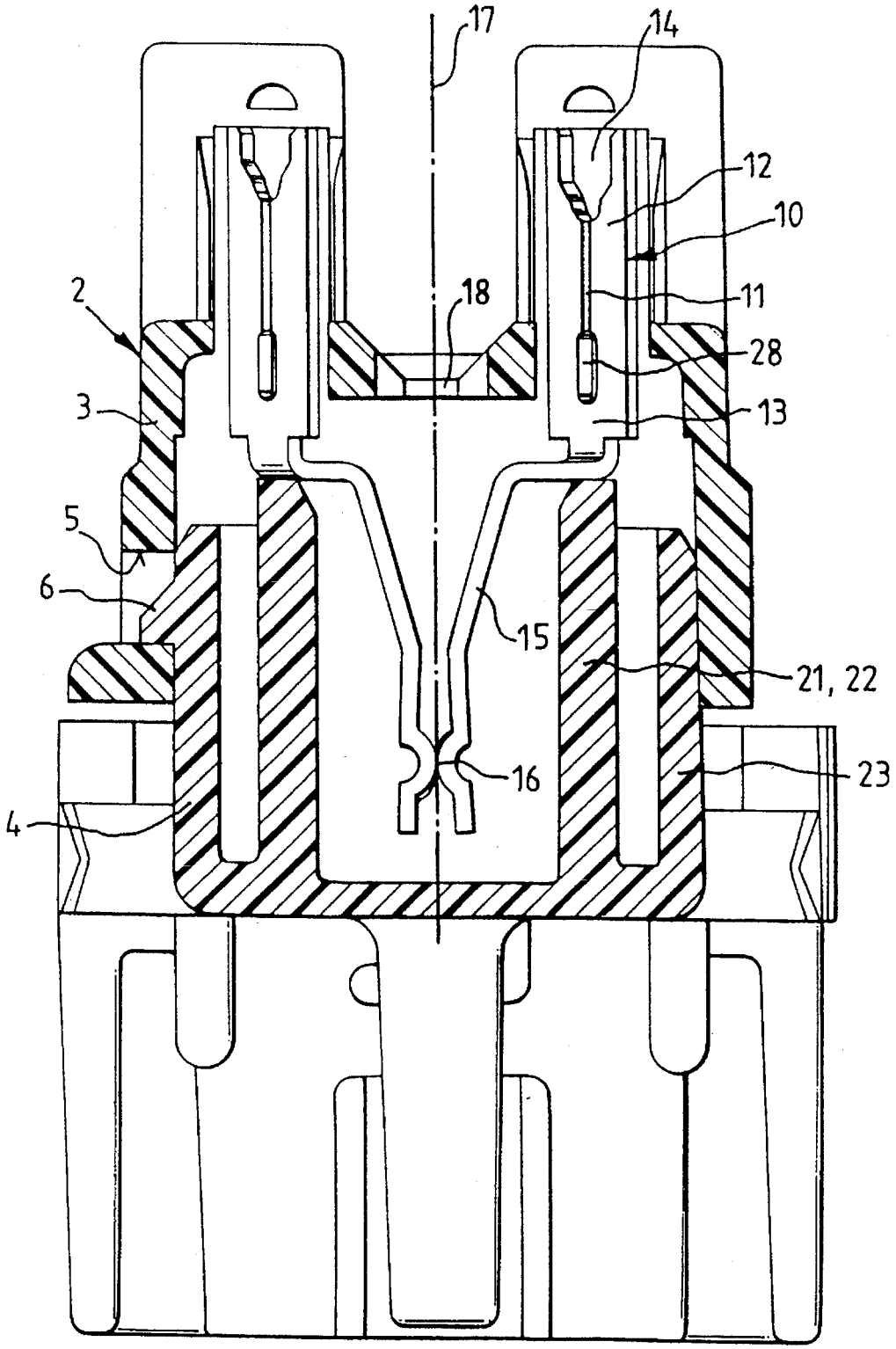
FIG. 5 is an enlarged cross-section of the terminal block according to FIG. 1.

As is shown in FIGS. 1 and 2, the spacing (the distance) d between two immediately adjacent clamping slots 7 serving for the insertion of a pair of insulation displacement contact elements 10 is 3 mm and thus substantially smaller than the spacing D of 9.8 mm between two adjacent pairs of clamping slots 7 or insulation displacement contact elements 10 provided therein, resp. This larger spacing D serves to reduce the capacities generated between the insulation displacement contact elements 10 forming condenser plates, in order to improve the crosstalk values and to obtain an improved crosstalk attenuation.

The individual insulation displacement contact elements 10 are each formed of, or as, a blade-type material and comprise only two side webs 12 of very narrow construction. The contact elements 10 include a contact slot 11 defined between the two side webs 12 and a narrow base web 13 connecting the two blade-type side webs 12 to each other. The contact slot 11 has a V-shaped introduction area 14 and an oval enlarged end area 28. Upon the base web 13 of the insulation displacement contact element 10 follows one contact finger 15 each, which extends at an inwardly bent off direction approximately at a right angle at the base web 13 and is then transformed into a spring contact 16 located in the area of the center line 17 of the casing 2. By the described construction of the conductive insulation displacement contacts elements 10 can be made from a flat or sheet material, the capacities generated between the two insulation displacement contact elements 10 of a pair aligned in a row are further reduced, and thus the crosstalk values are further improved, so that a very high crosstalk attenuation is obtained even within a pair of insulation displacement contact elements 10.

The casing 2 comprises, between the two rows of insulation displacement contact elements 10, a row of insertion openings 18 for plugs 19 serving to interrupt the contact connection between the spring contacts 16. The individual plugs 19 are provided, in their plastic casings, with a web-type latch element 20, which is attached in a rocker-type manner at the casing of plug 19.

Figure 4:
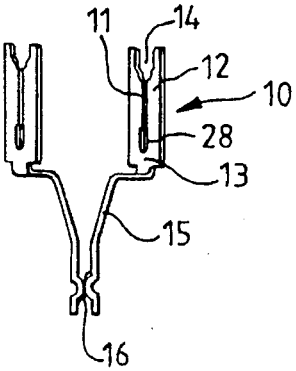
FIG. 4 is an individual representation of a pair of insulation displacement contact elements disposed in two opposite rows, in the first embodiment according to FIGS. 1 to 3.

In order to support the very short, flat insulation displacement contact elements 10 in the casing 2 for the purpose of applying the required connection force, continous support walls 22 forming support webs 21 are provided in the lower portion 4 of the casing 2. The support walls project over the outside walls 23 of the lower portion 4 and form counter-supports for the short insulation displacement contact elements 10. These contact elements are immediately supported in the section bent off by 90° of the contact fingers 15, as is shown in FIG. 4.

Figure 3:
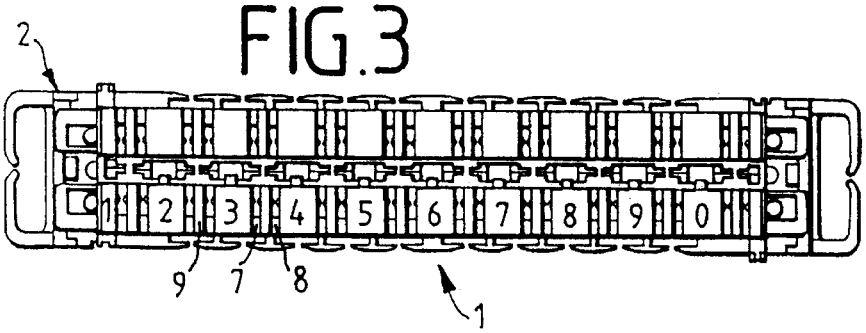
FIG. 3 is a top view according to FIG. 1.

The lower portion 4 of the casing comprises, according to FIGS. 1 to 3, cable guiding portions 24, 25 and pair-wise disposed latch webs 26, by means of which the terminal block 1 can be latched onto a structure (not shown) of parallel rods. As is shown in FIG. 1 in broken lines, the terminal block 1 can also be latched onto a U-shaped mounting bracket 27, the side walls 28 of which form lugs to latch into the terminal blocks 1.

To the insulation displacement contact elements 10 can be connected cable pairs 29 of cable wires having conductor cross-sections of 0.40 to 0.64. Crosstalk attenuation is 42 to 48 dB.

Figure 6:
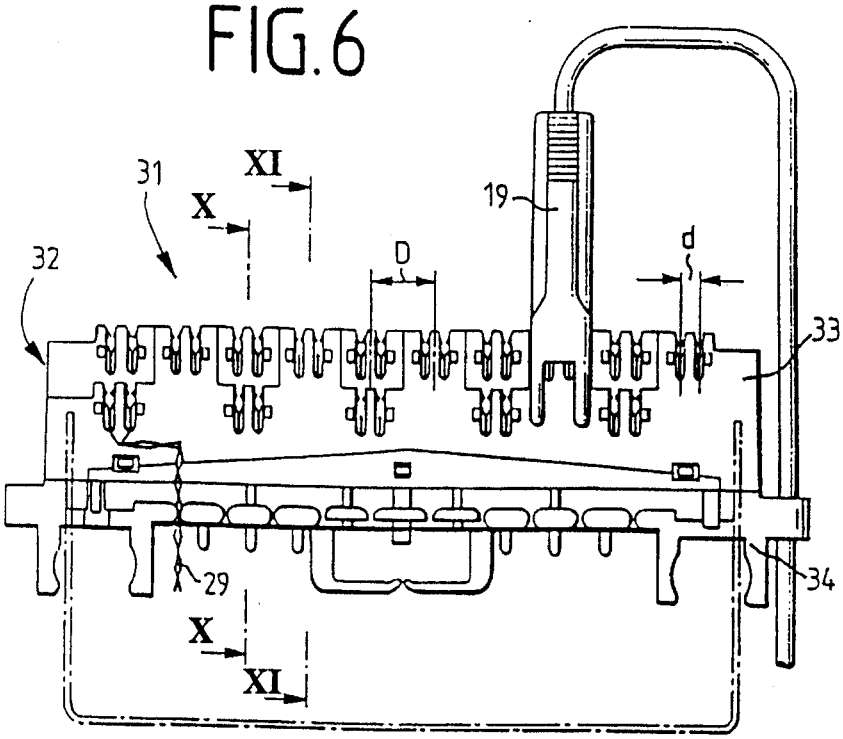
FIG. 6 is a view of the second embodiment of the terminal block.
Figure 9:
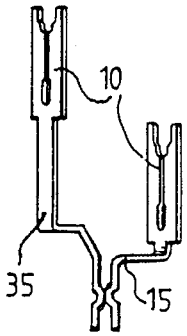
FIG. 9 is an individual representation of a pair of insulation displacement contact elements disposed in two opposite rows, for the terminal block in the second embodiment according to FIGS. 6 to 8.
Figure 8:
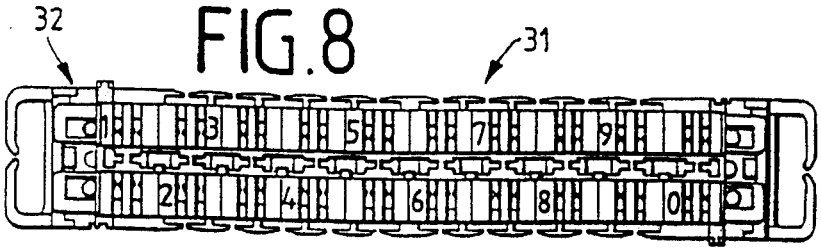
FIG. 8 is a top view.
Figure 10:
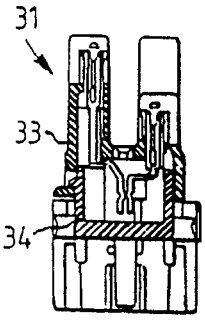
FIG. 10 is a cross-section of the terminal block along line X—X according to FIG. 6.
Figure 11:
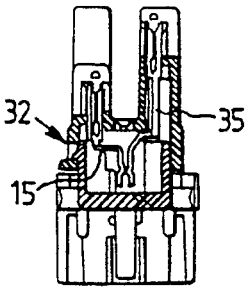
FIG. 11 is a cross-section along line XI—XI of the terminal block according to FIG. 6.
Figure 7:
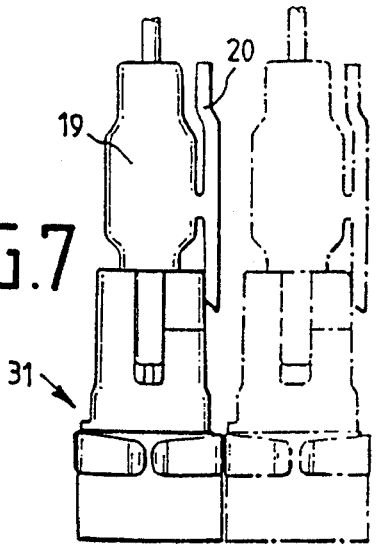
FIG. 7 is a side view.
Figure 12:
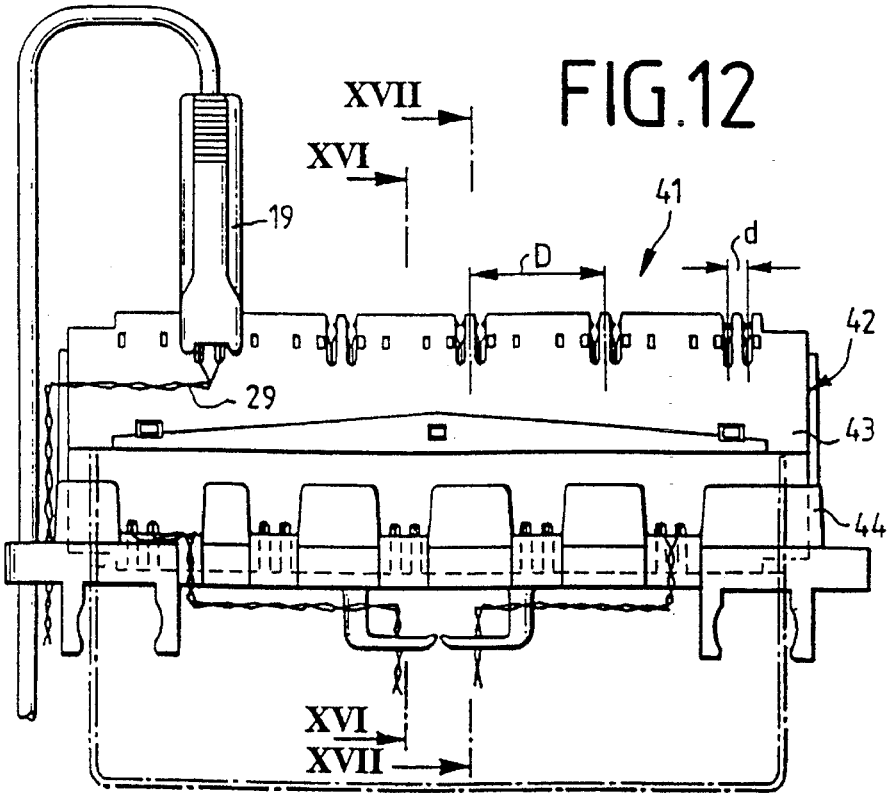
FIG. 12 is a view of the third embodiment of the terminal block.
Figure 15:
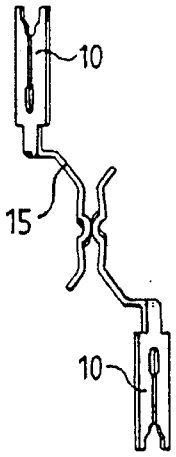
FIG. 15 is a pair of insulation displacement contact elements disposed in two opposite rows, for the terminal block in the third embodiment according to FIGS. 12 to 14.
Figure 14:
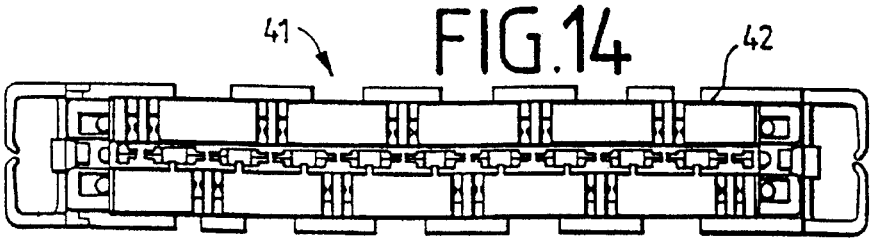
FIG. 14 is a top view.
Figure 16:
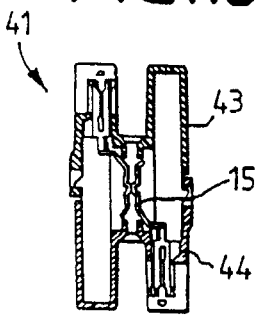
FIG. 16 is a cross-section along line XVI—XVI of the terminal block according to FIG. 12.
Figure 17:
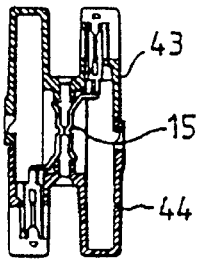
FIG. 17 is a cross-section along line XVII—XVII of FIG. 12.
Figure 13:
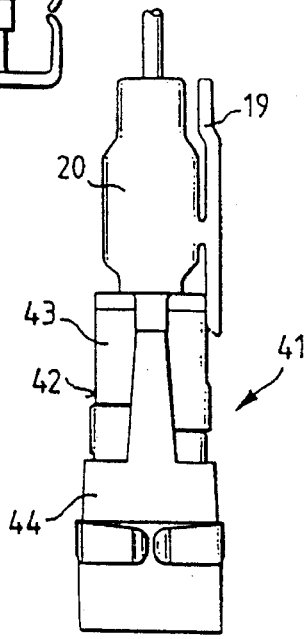
FIG. 13 is a side view.

The terminal block 31 according to the second embodiment shown in FIGS. 6 to 11 differs from the first embodiment of the terminal block 1 shown in FIGS. 1 to 5 in that a first pair of the insulation displacement contact elements 10 are located in an upper portion 33 of the casing 32 at a deeper position which is vertically below (based on the disposition of the terminal block 31, as shown in FIG. 6); another pair of insulation displacement contact elements 10 of the opposite row. The first pair of insulation displacement contact elements 10 are also positioned vertically to the two laterally adjacent insulation displacement contact elements 10 of the same row. The lengths of the contact fingers 15, 35 are also different as shown in FIG. 9. Crosstalk is here between 46 and 52 dB.

In the third embodiment of the terminal block 41 shown in FIGS. 12 to 17, the insulation displacement contact elements 10 of a pair are located on the opposite upper and lower sides of the casing 42 being formed of two nearly identical lower and upper portions 43 and 44, resp. The spacing D between two pairs of insulation displacement contact elements 10 disposed in a row is here 19.5mm. The respective pair of insulation displacement contact elements 10 is provided on the respectively opposite side of the lower or upper portion 43 or 44, resp., of the casing 42, as is shown in the sectional representations according to FIGS. 16 and 17. The construction of the insulation displacement contact elements 10 having contact fingers 15 substantially corresponds to that of FIG. 4, the insulation displacement contact elements 10 for the third embodiment of the terminal block 41 according to FIG. 15 being diametrically offset. The terminal block 41 can be rotated by 180° for wiring the two sides.

By the first embodiment according to FIGS. 1 to 5, crosstalk attenuation of approximately –49 dB can be obtained with transmission rates of approximately 100 MHz.

While specific embodiments of the invention have been shown and described in detail to illustrate the application of the principles of the invention, it will be understood that the invention may be embodied otherwise without departing from such principles.

What is claimed is:

1. A terminal block for high telecommunications and data transmission rates, the terminal block comprising:

a plastic casing;

a plurality of metal insulation displacement contact elements, each of said plurality of metal insulation displacement contact elements being formed of flat material and including narrow side webs, said side webs defining a contact slot between said side webs, a base web connecting said side webs, and a spring contact connected to said base web, said spring contact having a small width, said insulation displacement contact elements being positioned in said plastic casing to define a first row of contact slots and a second a second row of contact slots, said first row being opposite said second row, said insulation displacement contact elements being disposed in said plastic casing grouped in pairs, each pair including a first contact element and a second contact element, a spring contact of said first contact element of a pair of contact elements of said first row being disposed to engage a corresponding spring contact of a first contact element of a pair of contact elements of said second row and a spring contact of said second contact element of a pair of contact elements of said first row being disposed to engage a corresponding spring contact of a second contact element of a pair of contact elements of said second row, whereby a wire connected to said first contact of a pair of contacts of said first row is electrically connected to a wire connected to said first contact of a pair of contacts of said second row and a wire connected to said second contact of a pair of contacts of said first row is electrically connected to a wire connected to said second contact of a pair of contacts of said second row, said first contact of each pair being spaced from a second contact of said pair by a distance, said distance being smaller than a spacing between adjacent pairs in said first row and said second row.

2. A terminal block in accordance with claim 1, wherein:

said distance between each of said metal insulation displacement contact elements in said pairs is substantially 3 mm and said spacing between adjacent pairs is substantially between 9 to 10 mm.

3. A terminal block in accordance with claim 1, wherein:

said spring contact extends away from said base web at an angle;

said plastic casing includes support means for supporting said plurality of metal insulation displacement contact elements, said support means including a support web as a counter support for said plurality of metal insulation displacement contact elements.

4. A terminal block in accordance with claim 3, wherein:

said plastic case includes outside walls, and said support web extends further away from said plastic case than said outside walls.

5. A terminal block in accordance with claim 3, wherein:

said support web forms a continuous support wall.

6. A terminal block in accordance with claim 1, wherein:

a first half of said pairs of said insulation displacement contact elements are positioned at a side of said case, a second half of said pairs of said insulation displacement contact elements are positioned on said case farther away from said side of said case than immediately adjacent insulation displacement contact elements in a same and opposite row.

7. A terminal block in accordance with claim 1, wherein:

a first half of said pairs of said insulation displacement contact elements are positioned at a side of said case, a second half of said pairs of said insulation displacement contact elements are positioned on an opposite side of said case from adjacent insulation displacement contact elements.

8. A terminal block in accordance with claim 7, wherein:

said casing includes an tipper portion and a lower portion, said upper and lower portions being substantially identical.

9. A terminal block for high telecommunications and data transmission rates, the terminal block comprising:

a casing;

a plurality of insulation displacement contact elements positioned in a plurality of rows in said casing, said plurality of insulation displacement contact elements being grouped in pairs, each of said plurality of insulation displacement contact elements being formed of flat material and including side webs, said side webs defining a contact slot between said side webs, a base web connecting said side webs, and also including a spring contact connected to said base web, a first half of said pairs of said insulation displacement contact elements are positioned at a first side of said case, a second half of said pairs of said insulation displacement contact elements are positioned on a second side of said case, each said spring contact of said first side engaging a corresponding spring contact of said second side, a first contact of each pair being spaced from a second contact of said pair by a distance, said distance being smaller than a spacing between adjacent pairs at said first side and said second side of said case.

10. A terminal block in accordance with claim 9, wherein:

said each of said second half of said pairs of said insulation displacement contact elements are positioned on an opposite side of said case from said adjacent insulation displacement contact elements in a same and opposite row.

11. A terminal block in accordance with claim 10, wherein:

said casing includes a first part and a second part, said first half of said pairs of said insulation displacement contact elements being positioned in said first part of said casing, said second half of said pairs of said insulation displacement contact elements being positioned in said second part of said casing, said first and second parts being substantially identical and connectable to form said casing.

12. A terminal block in accordance with claim 1, wherein:

each said spring contact extends from an associated said base web in a direction away from an associated said contact slot.

13. A terminal block in accordance with claim 1, wherein:

said first row is substantially parallel to said second row, said engaged spring contacts defining a contact connection row which is substantially parallel to said first row and said second row, said contact connection row being disposed on a side of said base webs which is opposite from said first row and said second row.

14. A terminal block for high telecommunications and data transmission rates, the terminal block comprising:

a plastic casing;

a plurality of metal insulation displacement contact elements, each of said plurality of metal insulation displacement contact elements being formed of fiat material and including narrow side webs, said side webs defining a contact slot between said side webs, a base web connecting said side webs, and a spring contact connected to said base web, said spring contact having a small width, said insulation displacement contact elements being positioned in said plastic casing to define a first row of contact slots and a second row of contact slots, said first row being opposite said second row, said insulation displacement contact elements being disposed in said plastic casing grouped in pairs, each pair including a first contact element and a second contact element, a spring contact of said first contact element of a pair of contact elements of said first row being disposed to engage a corresponding spring contact of a first contact element of a pair of contact elements of said second row and a spring contact of said second contact element of a pair of contact elements of said first row being disposed to engage a corresponding spring contact of a second contact element of a pair of contact elements of said second row, whereby a wire connected to said first contact of a pair of contacts of said first row is electrically connected to a wire connected to said first contact of a pair of contacts of said second row and a wire connected to said second contact of a pair of contacts of said first row is electrically connected to a wire connected to said second contact of a pair of contacts of said second row, each said spring contact extending from an associated said base web in a direction away from an associated said contact slot.

15. A terminal block in accordance with claim 14 wherein:

a distance between two adjacent of said pairs of metal insulation displacement contact elements is larger than a distance between each of said metal insulation displacement contact elements in said pairs.

* * * * *

UNITED STATES PATENT AND TRADEMARK OFFICE

CERTIFICATE OF CORRECTION

PATENT NO. : 5,494,461

DATED : February 27, 1996

INVENTOR(S) : Bippus et al

It is certified that error appears in the above-identified patent and that said Letters Patent is hereby corrected as shown below:

On the title page, item [75] Inventors: the third inventors name "Bryce L. Nicholss" should read --Bryce L. Nicholls--.

Signed and Sealed this

Tenth Day of September, 1996

*Attest:*

*Attesting Officer*

BRUCE LEHMAN

*Commissioner of Patents and Trademarks*